US006930270B2

(12) United States Patent
Fieberg et al.

(10) Patent No.: US 6,930,270 B2
(45) Date of Patent: Aug. 16, 2005

(54) CONNECTION AREA BETWEEN HOUSING PARTS OF A VACUUM INTERRUPTER, AND A VACUUM INTERRUPTER HAVING A CONNECTION AREA OF THIS TYPE

(75) Inventors: Klemens Fieberg, Berlin (DE); Klaus Gessner, Berlin (DE); Jürgen Jirasek, Falkensee (DE); Lutz Kellmann, Berlin (DE); Klaus Oberndörfer, Berlin (DE); Thomas Pfohl, Berlin (DE); Roman Renz, Berlin (DE); Michael Westerkowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 4 days.

(21) Appl. No.: 10/450,382

(22) PCT Filed: Oct. 5, 2001

(86) PCT No.: PCT/DE01/03878

§ 371 (c)(1),
(2), (4) Date: Nov. 18, 2003

(87) PCT Pub. No.: WO02/49056

PCT Pub. Date: Jun. 20, 2002

(65) Prior Publication Data

US 2004/0074874 A1 Apr. 22, 2004

(30) Foreign Application Priority Data

Dec. 13, 2000 (DE) ..... 100 62 760

(51) Int. Cl.[7] ..... H01H 33/66
(52) U.S. Cl. ..... 218/134; 218/68
(58) Field of Search ..... 218/10, 17, 48–77, 218/118–139, 155; 29/622

(56) References Cited

U.S. PATENT DOCUMENTS

| | | | | |
|---|---|---|---|---|
| 4,077,114 A | * | 3/1978 | Sakuma | 29/622 |
| 4,088,860 A | * | 5/1978 | Abe et al. | 218/136 |
| 4,733,456 A | * | 3/1988 | Sofianek et al. | 29/622 |
| 5,222,651 A | | 6/1993 | Pilsinger et al. | |
| 6,533,161 B1 | | 3/2003 | Gessner | |

FOREIGN PATENT DOCUMENTS

| | | |
|---|---|---|
| DE | 3628174 A1 | 2/1988 |
| DE | 8810941.0 | 10/1988 |
| DE | 8709569.6 | 11/1988 |
| DE | 3719256 A1 | 12/1988 |
| DE | 3931774 A1 | 4/1991 |
| DE | 4320910 C1 | 9/1994 |
| DE | 19753031 C1 | 4/1999 |

* cited by examiner

*Primary Examiner*—Lincoln Donovan
*Assistant Examiner*—M. Fishman
(74) *Attorney, Agent, or Firm*—Morrison & Foerster LLP

(57) ABSTRACT

The aim of the invention is to optimize, in vacuum interrupters, the connection area (12, 13, 14) between housing parts (2, 3, 4, 5), which are coaxially assigned to one another, with regard to the complexity of production for centering measures and with regard to the execution of the soldering process. To this end, a ring-like discoidal centering means (15) is used, which is made of a silver-coated copper and which comprises centering lugs (18) located on a tubular flange (17) that is arranged on the inner periphery of the centering means. Said centering lugs extend in an axial direction of the coaxial assignment and are provided in the form of tabs that point toward the ring-like discoidal area (24) of the centering means. The centering means is thereby overlapped by a tubular copper part, which is joined to the centering means and which serves as a shielding (10) inside the vacuum interrupter.

10 Claims, 2 Drawing Sheets

CONNECTION AREA BETWEEN HOUSING PARTS OF A VACUUM INTERRUPTER, AND A VACUUM INTERRUPTER HAVING A CONNECTION AREA OF THIS TYPE

CLAIM FOR PRIORITY

This application claims priority to Application No. 100627609 which was filed in the German language on Dec. 13, 2000.

TECHNICAL FIELD OF THE INVENTION

The invention relates to vacuum-electronic components and, in particular, to for vacuumtight joining together of individual parts of vacuum interrupters.

BACKGROUND OF THE INVENTION

In the production of vacuum interrupters, in the final phase of the production process, a certain number of individual parts and assemblies have to be joined together to form a complete unit. The housing thereby formed has to be evacuated and sealed in a vacuumtight manner. To reduce the use of soldering forms when joining together the individual parts and assemblies and the subsequent soldering process, or to be able to dispense entirely with such soldering forms, it is known to assign individual parts to one another in a self-centering manner. In the case of vacuum interrupters with a hollow-cylindrical ceramic insulator and two end caps made of high-grade steel as housing parts, it may be envisaged, for example, to connect the end caps to the ceramic insulator by means of end-on soldering with a compensating layer of copper interposed. For the self-entering of the parts which are to be connected, it is typical to form the compensating layer in one piece with a control shield covering the inner edge of the ceramic insulator and to provide the parts both with a first centering portion, which bears against the inner surface of the ceramic insulator, and with a second centering portion, which centers the end cap. The first centering portion may in this case be formed by peripherally arranged projections which are elastically resilient in the inward direction and, for this purpose, are formed as bosses and are surrounded by a horseshoe-shaped punched clearance. The second centering portion is formed by an annular centering lug (See, for example, DE 36 28 174 A1). A known variant of this configuration envisages use of the bosses in the peripheral direction of the control shield tabs that are made to protrude (See, for example, DE 39 31 774 A 1). Such centering elements may also be used in the case of vacuum interrupts with two ceramic insulators arranged coaxially one behind the other, to achieve for a shielding held in the joining region of these insulators a self-centering effect in this area. Alternatively, this is also possible with a holding part in the form of an annular disk, which for connection to the shielding merges with a tubular lug and is provided in the disk-shaped region with tabs made to protrude in the axial direction, which are pressed out alternately in one direction and in the other direction (See, for example, DE 37 19 256 A1).

In the case of vacuum interrupters in which no control shield in the end region of the ceramic insulator or any shielding is required, the compensating layer of copper in the form of an annular disk may also be provided with inner tabs for centering the annular disk on the inner side of the ceramic insulator and with outer tabs for centering the end cap (cover) (See, for example, DE 87 09 569 U1).

It is further known in the case of vacuum interrupters in which metal housing parts are connected to ceramic insulators without the use of a compensating layer by means of blade soldering, to couple the self-centering measures with the soldering process in such a way that the soldering foil itself serves as the centering means. In this case, the soldering process may be devices as seal-soldering (See, for example, DE 197 53 031).

In order to simplify, in the case of vacuum interrupters, the soldering technique for connecting ceramic parts to copper parts, in particular so-called blade soldering, but also the connection of copper parts to one another or to other metal parts, it is further known to use copper parts which are provided with a silver layer both in the area of the actual connecting location and in areas adjoining that, if appropriate as a complete unit. At a soldering temperature of around 800° C., this silver layer forms with the surface layer of the copper part a eutectic connection, which at the same time represents the soldering material. In this way it is possible for example to connect a copper housing cap simultaneously and in a vacuumtight manner to a ceramic insulator and in an adhesively/cohesively bonded manner to a shielding ring (See, for example, DE 43 20 910 C1).

Starting from a connection area between two housing parts of a vacuum interrupter assigned coaxially to each other, in which one housing part is a hollow-cylindrical ceramic insulator which is connected at the end face to the outer housing part and in which an annular disk-like centering means placed onto the ceramic insulator and provided with centering lugs is arranged between the two housing parts, the invention is based on the object of optimizing the connection area with regard to the complexity of production for centering measures and with regard to the execution of the soldering process.

SUMMARY OF THE INVENTION

The invention discloses production technology for vacuum-electronic components and its use for the vacuumtight joining together of the individual parts of vacuum interrupters which have at least one connection area between two housing parts assigned coaxially to each other, one housing part being a hollow-cylindrical ceramic insulator which is connected at the end face to the other housing part, and a centering device placed onto the ceramic insulator being arranged between the two housing parts.

In one embodiment of the invention, a centering device has on the inner periphery a tubular flange protruding into the ceramic insulator and is provided with centering lugs, the centering lugs being formed as tabs extending in the axial direction of the coaxial assignment and pointing toward the annular disk-shaped region of the centering device. The centering device comprises a silver-coated copper part and that the centering means is covered by a tubular copper part serving within the vacuum interrupter as a shielding and is connected to the centering device.

In the case of such a configuration of the centering device, the centering device serves as a soldering foil and as a securement for a shielding covering over the centering area, and consequently placing the centering area in an electrical field shadow; when housing parts made of high-grade steel are used, the centering device can at the same time form a compensating layer. The arrangement of a tubular flange with centering lugs in the form of axially extending tabs pointing toward the annular disk-shaped region in this case permits a barb-like and consequently secure clamping of the centering device on the ceramic insulator.

In the case of the novel connection area, the second housing part may be a metal cover, which is connected to the first housing part by means of blade soldering. For this purpose, the cover is centered by means of flange arranged on the outer periphery of the annular disk-like centering device and extends in the axial direction of the coaxial assignment, while the tubular flange provided on the inner periphery of the annular disk-like centering means for centering the copper part serving as shielding is provided with further centering lugs, likewise formed as tabs. In the case of this configuration, the copper part serving as shielding is secured in an adhesively/cohesively bonded manner on the centering device after the soldering process by means of the silver-coated tabs. The copper part may in this case—depending on the arrangement of the copper part at the upper or lower end of a cylindrical vacuum interrupter—be arranged by means of a field-controlling extending of its one end in a suspended manner on the centering device or in a standing manner on the associated cover.

In the case of the configuration of the second housing part as a cover, the copper part which is connected to the centering device and serves as shielding may also be used for the centering of the cover, in that it is provided with a collar in the form of a circular arc, against which the cover comes to bear with its wall region and its bottom region.

In the case of the novel connection area, the second housing part may also be a further hollow-cylindrical ceramic insulator, the copper part serving as the shielding forming a main shield of the vacuum interrupter; in the case, in another embodiment of the invention, two annular disk-like centering devices are arranged mirror-symmetrically in relation to each other for the connection of the two ceramic parts, the main shield bearing in a precisely fitting manner against the tubular flanges of the two centering devices and resting on one tubular flange by means of an annular shoulder.

Connection areas formed according to the invention in still another embodiment of the invention in the case of vacuum interrupters may—depending on their area of use for low-, medium- or high-voltage purposes—be used individually, multiply or together and lend the construction of the housing, including the shieldings, a characteristic distinctive form.

BRIEF DESCRIPTION OF THE DRAWINGS

Exemplary embodiments of a vacuum interrupter formed according to the invention with three connection areas is represented in the figures below, in which.

DETAILED DESCRIPTION OF THE INVENTION

Figure 1:
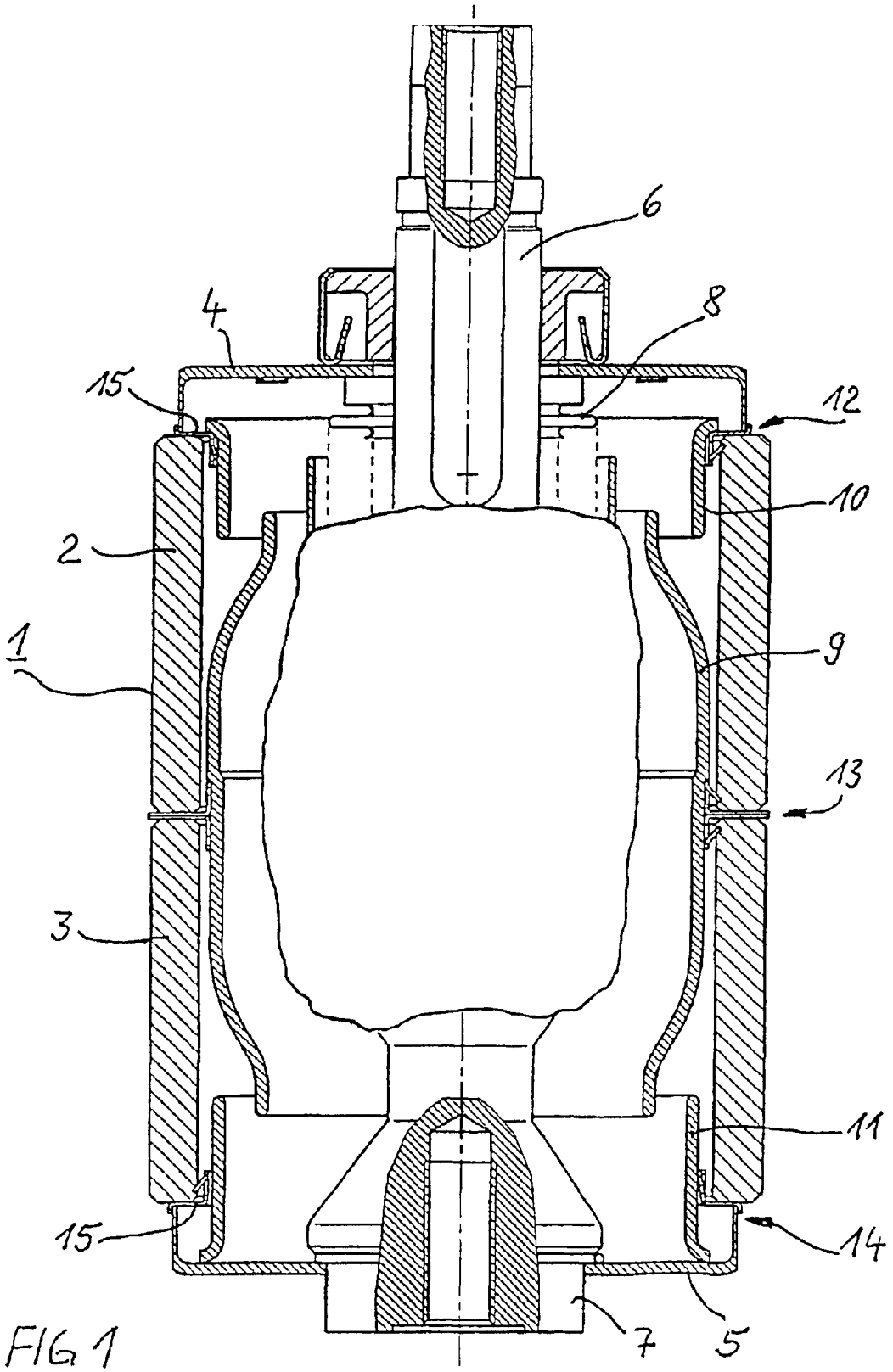
FIG. 1 shows the housing of vacuum interrupter for the medium-voltage range with two coaxially arranged ceramic insulators and two covers and also with shieldings assigned to the housing.

FIG. 1 shows the housing 1 of a vacuum interrupter which substantially comprises two hollow-cylindrical ceramic insulators 2 and 3 arranged coaxially in relation to each other and two covers 4 and 5, through which current feeding pins 6 and 7 to a contact arrangement (not represented in any more detail) are led. Part of the housing is also a bellows 8, which is soldered on the one hand to the cover 4 and on the other hand to the current feeding pins 6. Arranged inside the housing are a main shield 9 and, as shielding elements, an upper end shield 10 and a lower end shield 11. The housing 1 also has three connection areas 12, 13 and 14, in which the covers 4 and 5 are connected to the ceramic insulators 2 and 3 and the two ceramic insulators 2 and 3 are connected to each other. To produce these connection areas, centering device described in more detail below are used.

Figure 4:
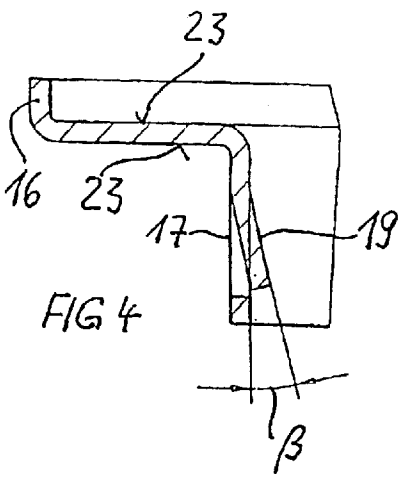
FIG. 4 shows the configuration of a connection area with a shielding element in a suspended arrangement.
Figure 3:
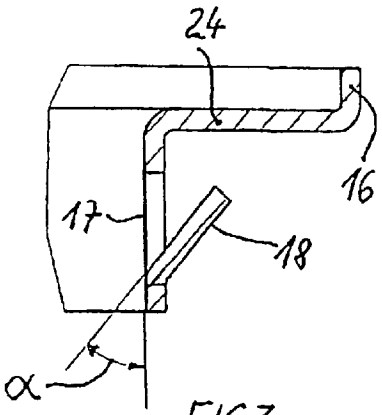
FIG. 3 shows a cross section of the centering device used in FIG. 1 for the central assignment of ceramic insulators and covers.
Figure 2:
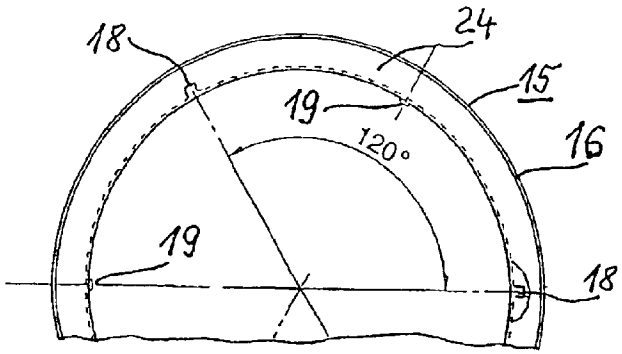
FIG. 2 shows a plan view of FIG. 1.

A centering device 15, which according to FIGS. 2 to 4 is formed in the manner of an annular disk and has an annular disk-shaped region 24, a flange 16 arranged on the outer periphery and extending in the axial direction and a flange 17 arranged on the inner periphery and extending in a tubular manner in the opposite direction to that of the outer flange 16, is used for the two connection areas 12 and 14. The tubular flange 17 has on the one hand three centering lugs in the form of tabs arranged uniformly on the periphery and made to protrude outward by an angle $\alpha$ of approximately 40°, these tabs pointing toward the annular disk-shaped region 24. The tubular flange 17 also has between the tabs 16 three centering lugs 19, likewise arranged uniformly on the periphery, in the form of tabs which are made to protrude inward by an angle $\beta$ of approximately 13° and point away from the annular disk-shaped region 24.

In the case of this configuration of the centering device, the lugs 18 serve for the centering of the centering means 15 in the associated ceramic insulator, the tabs 19 serve for the central arrangement of a shielding element to be assigned to the centering means and the flange 16 serves for the central arrangement of the associated cover. If there is an appropriate fit between the flange 17 and the shielding element, it may be possible to dispense with the tabs 19.

Figure 5:
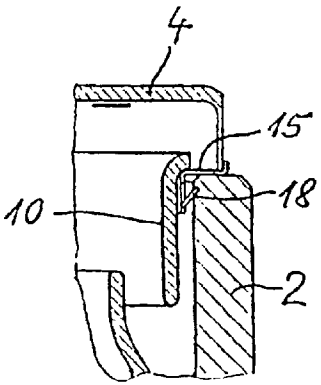
FIG. 5 shows the assignment of the centering means to the ceramic insulator and the assignment of the cover and the end shield to the centering device.

FIG. 5 shows the assignment of the centering means 15 to the ceramic insulator 2 and also the assignment of the cover 4 and the end shield 10 to the centering device. In the figure, only the tabs 18 can be seen.

Figure 6:
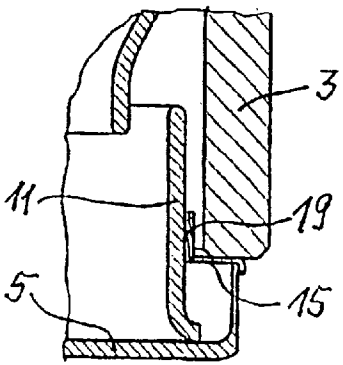
FIG. 6 shows a connection area with a shielding element in a standing arrangement.

FIG. 6 shows the assignment of the centering device 15 to the ceramic insulator 3 and also the assignment of the cover 5 and the end shield 11 to the centering device 15. In this case, the tabs 19 serving for centering the end shield 11 can be seen.

Figure 7:
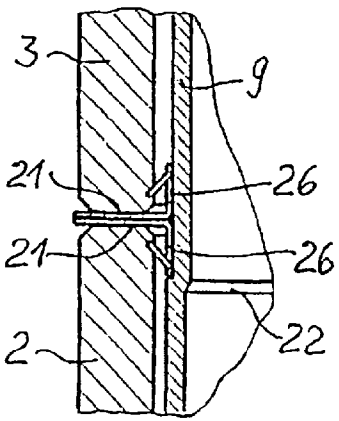
FIG. 7 shows the connection area between two ceramic insulators with assigned main shield.

According to FIG. 7, two centering devices 21, which in principle are formed in the same way as the centering device 15 but have not flange 16 and no tabs 19, are used for the connection area 13. The two centering devices 21 are placed against each other with their annular disk-shaped region in such a way that the tubular flange parts 26 extend in opposite directions from each other. The main shield 9 bears against these flange parts, it having an annular shoulder 22 with which it rests on the rim of the tubular flange of the upper centering device 21.

Figure 8:
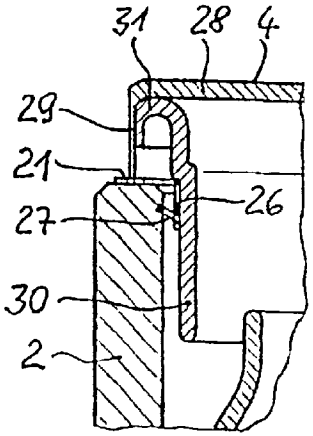
FIG. 8 shows a connection area between a ceramic insulator and a cover, using a shielding centering the cover.

According to FIG. 8, a centering ring 21, which is formed in a way similar to the centering ring 21 according to FIG. 7 and has a tubular flange part 26 with tabs 27 made to protrude, is provided as the centering device for a connection area between a ceramic insulator 2 and a cover 4, which has a bottom 28 and a wall 29; suspended on the centering ring 21 is an end shield 30, which has a collar 31 flanged outward in the form of a circular arc, with which the cover 4 is centered with respect to the ceramic insulator 2. The collar 31 is shaped in such a way that the cover 4 bears against the collar 31 with the tubular wall region 29, if appropriate also with the bottom region 28.

In the case of the exemplary embodiment represented, the main shield 9, the end shields 10, 11 and 30 and the covers 4 and 5 consist of copper. The centering devices 15 and 21 likewise consist of copper, but are coated with a silver layer 23 over their full surface area. By means of the silver layer, during the seal-soldering of the vacuum interrupter, the main shield 9 and the end shields 10, 11 and 30 are also adhesively/cohesively bonded to the centering device 5 and 21, respectively.

What is claimed is:

1. A connection area between two housing parts of a vacuum interrupter assigned coaxially to each other, comprising:

a first housing part having a hollow-cylindrical ceramic insulator which is connected at an end face to a second housing part; and a centering device placed onto the ceramic insulator which is arranged between the first and second housing parts, which centering device is formed as an annular disk and has, on an inner periphery, a tubular flange protruding into the ceramic insulator and is provided with centering lugs, the centering lugs being formed as tabs extending in an axial direction of the coaxial assignment and pointing toward an annular disk-shaped region of the centering device, and wherein the centering device comprises a silver-coated copper part and is covered by tubular copper part serving within the vacuum interrupter as a shielding and is connected to the centering device.

2. The connection area as claimed in claim 1, wherein the second housing part is a metal cover, which is connected to the first housing part by means of blade soldering and is centered by means of a flange arranged on an outer periphery of the annular disk-like centering device and extends in the axial direction of the coaxial assignment, and the tubular flange is provided on the inner periphery of the annular disk-like centering device for centering the copper part serving as shielding and is provided with additional centering lugs which are formed as tabs.

3. The connection area as claimed in claim 1, wherein the second housing part is a metal cover, which is connected to the first housing part by means of blade soldering, and the copper part which is connected to the centering device and serves as shielding is provided with a collar flanged in the form of a circular arc for centering of the cover.

4. The connection area as claimed in claim 2, wherein the copper part serving as shielding is arranged in a suspended manner on the centering device.

5. The connection area as claimed in claim 2, wherein the copper part serving as shielding is arranged in a standing manner on the metal cover.

6. The connection area as claimed in claim 1, wherein the second housing part is a hollow-cylindrical ceramic insulator and the copper part serving as shielding forms a main shield of the vacuum interrupter, two annular disk-like centering devices being arranged symmetrically in relation to each other and the main shield bearing in a precisely fitting manner against the tubular flanges of the two centering devices and resting on one tubular flange by means of an annular shoulder.

7. A vacuum interrupter with a housing which surrounds a contact arrangement, comprising:

a hollow-cylindrical housing part;

two cover parts coaxially assigned to the housing part, the hollow-cylindrical housing part having at least one ceramic insulator and the cover parts being penetrated by connection pins leading to the contact arrangement;

at least one cover part connected to the hollow-cylindrical housing part by means of blade soldering; and at least one shielding arranged inside the housing, where a connection area is formed by blade soldering and the connection area comprises a centering device placed onto the at least one ceramic insulator which is arranged between the first and second housing parts, which centering device is formed as an annular disk and has, on an inner periphery, a tubular flange protruding into the ceramic insulator and is provided with centering lugs, the centering lugs being formed as tabs extending in an axial direction of the coaxial assignment and pointing toward an annular disk-shaped region of the centering device, and wherein the centering device comprises a silver-coated copper part and is covered by a tubular copper part serving within the vacuum interrupter as a shielding and is connected to the centering device.

8. The vacuum interrupter as claimed in claim 7, wherein the connection area has a copper part serving as shielding and is arranged in a suspended manner on the centering device.

9. The vacuum interrupter as claimed in claim 8, wherein an additional connection area has a copper part serving as shielding and is arranged in a standing manner on the metal cover.

10. The vacuum interrupter as claimed in claim 7, wherein the hollow-cylindrical housing part has at least two ceramic insulators arranged coaxially in relation to each other and is formed in the connection area, wherein one of the housing parts is a hollow-cylindrical ceramic insulator and a copper part serving as shielding forms a main shield of the vacuum interrupter, two annular substantially disk shaped centering devices being arranged symmetrically in relation to each other and a main shield bearing in a precisely fitting manner against tubular flanges of the two centering devices and resting on one tubular flange by means of an annular shoulder.

* * * * *